US008584731B1

(12) United States Patent
Konrad et al.

(10) Patent No.: US 8,584,731 B1
(45) Date of Patent: Nov. 19, 2013

(54) SHUTTER SLAT FOR A ROLLING SHUTTER SYSTEM

(75) Inventors: Walter M. Konrad, Pearland, TX (US); Stefan A. Poetsch, Houston, TX (US); Ricardo Gomez, Houston, TX (US); Crista Renouard, Webster, TX (US)

(73) Assignee: Rollac Shutter of Texas, Inc., Pearland, TX (US)

( * ) Notice: Subject to any disclaimer, the term of this patent is extended or adjusted under 35 U.S.C. 154(b) by 111 days.

(21) Appl. No.: 12/710,229

(22) Filed: Feb. 22, 2010

Related U.S. Application Data

(60) Provisional application No. 61/166,083, filed on Apr. 2, 2009.

(51) Int. Cl.
*E06B 3/06* (2006.01)

(52) U.S. Cl.
USPC ..... 160/235; 160/133

(58) Field of Classification Search
USPC ..... 160/235, 236, 186, 229.1, 233, 234
See application file for complete search history.

(56) References Cited

U.S. PATENT DOCUMENTS

| | | | | | |
|---|---|---|---|---|---|
| 3,012,318 | A * | 12/1961 | Nelson | 72/47 |
| 4,723,588 | A * | 2/1988 | Ruppel | 160/236 |
| 5,204,147 | A * | 4/1993 | Schneider | 428/35.8 |
| 5,343,922 | A * | 9/1994 | Rankl et al. | 160/133 |
| 5,365,990 | A * | 11/1994 | Ueda | 160/23.1 |
| 5,419,386 | A * | 5/1995 | Magro et al. | 160/232 |
| 5,474,118 | A * | 12/1995 | Hoffman | 160/235 |
| 5,515,902 | A * | 5/1996 | Hoffman | 160/235 |
| 5,601,130 | A * | 2/1997 | Werner et al. | 160/183 |
| 5,611,383 | A * | 3/1997 | Hoffman | 160/133 |
| 5,613,539 | A * | 3/1997 | Kraler | 160/32 |
| 5,839,493 | A * | 11/1998 | Quasius | 160/133 |
| 5,850,862 | A * | 12/1998 | Miller | 160/133 |
| 5,957,186 | A * | 9/1999 | Boswell | 160/201 |
| 6,345,476 | B1 * | 2/2002 | Hill | 52/202 |
| 7,100,665 | B2 * | 9/2006 | Miller | 160/235 |
| 7,357,171 | B2 * | 4/2008 | Miller | 160/235 |
| 7,784,522 | B2 * | 8/2010 | Miller | 160/235 |
| 8,109,316 | B2 * | 2/2012 | Wang | 160/232 |
| 8,162,025 | B2 * | 4/2012 | Motosko et al. | 160/180 |
| 2003/0024659 | A1 * | 2/2003 | Begni | 160/235 |
| 2004/0003903 | A1 * | 1/2004 | Wenrick et al. | 160/236 |
| 2004/0188037 | A1 * | 9/2004 | Schlater et al. | 160/133 |
| 2005/0045280 | A1 * | 3/2005 | Schlater et al. | 160/133 |
| 2005/0205221 | A1 * | 9/2005 | Miller | 160/236 |
| 2005/0205222 | A1 * | 9/2005 | Miller | 160/236 |
| 2005/0205223 | A1 * | 9/2005 | Miller | 160/236 |
| 2007/0137802 | A1 * | 6/2007 | Lukasik et al. | 160/235 |
| 2007/0221341 | A1 * | 9/2007 | Schanz | 160/133 |
| 2008/0202700 | A1 * | 8/2008 | Miller | 160/133 |
| 2009/0178769 | A1 * | 7/2009 | Miller | 160/133 |
| 2011/0162807 | A1 * | 7/2011 | Miller | 160/133 |

OTHER PUBLICATIONS

HEROAL—Johann Henkenjohann GmbH & Co.KG, Rollgitter S, "Artikelliste", Feb. 1, 2002, Verl, Germany.

HEROAL—Johann Henkenjohann GmbH & Co.KG, Single Wall Slats, "Rolladenpreisliste", Jan. 1987, Verl, Germany.

* cited by examiner

*Primary Examiner* — Katherine Mitchell
*Assistant Examiner* — Jaime F Cardenas-Garcia
(74) *Attorney, Agent, or Firm* — Buskop Law Group, PC; Wendy Buskop

(57) ABSTRACT

The present embodiments relate to a shutter slat for a rolling shutter system that has a one piece integral construction with a first end and a second end that pivotally interlock with each other.

11 Claims, 4 Drawing Sheets

REPLACEMENT SHEET
FIGURE 7
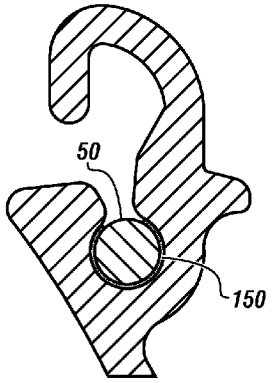

SHUTTER SLAT FOR A ROLLING SHUTTER SYSTEM

CROSS REFERENCE TO RELATED APPLICATIONS

The present application claims priority to and the benefit of U.S. Provisional Patent Application Ser. No. 61/166,083 filed on Apr. 2, 2009, entitled "Shutter Slat for a Rolling Shutter System. This reference is hereby incorporated in its entirety.

FIELD

The present embodiments generally relate to a shutter slat for a rolling shutter system.

BACKGROUND

A need exists for a lightweight, easy to install system that is flexible and can be quickly installed in the field in the event of strong winds, such as during a storm or hurricane.

Furthermore, there is a need for business owners especially retail store locations to protect their premises while still having the ability to present their merchandise or providing an insight view for authorities such as police or firefighters.

The present embodiments meet these needs.

BRIEF DESCRIPTION OF THE DRAWINGS

The detailed description will be better understood in conjunction with the accompanying drawings as follows:

FIG. 7 depicts an alignment device.

Figure 1:
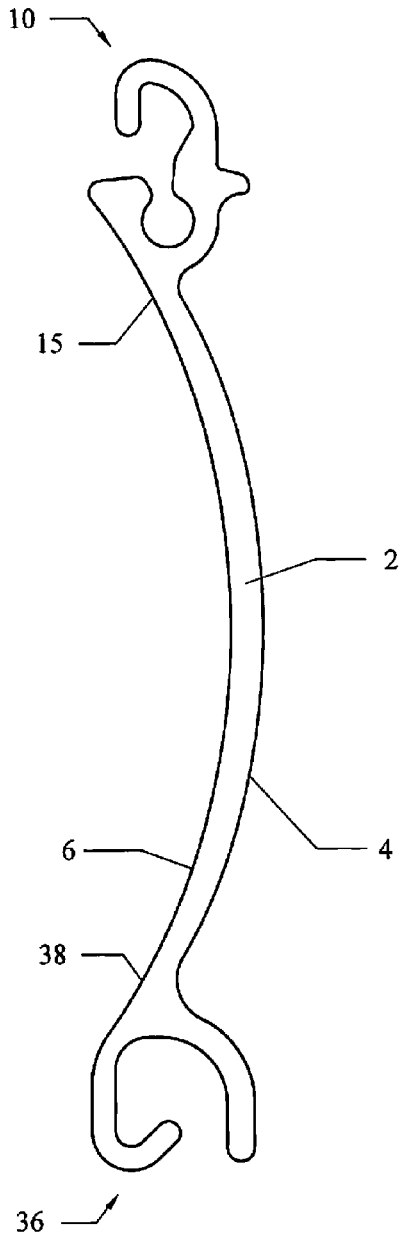
FIG. 1 is a side view of a slat body.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments relate to a shutter slat for a rolling shutter system.

In an embodiment, the shutter slat can have a single wall slat body with a curved front side and a curved back side. The shutter slat can further be a one piece integral item.

The shutter slat on one end, which can be a first end, of the body can have a top hook portion which can be constructed from a portion of the curved back side.

The top hook portion can have a fork shape with a ledge section and a hook section.

The ledge section can be formed from a portion of the curved back side. The ledge section can also have a first curved inner wall and a ledge can be a one piece unit integral with the body.

The top hook portion can have a hook section with an outer surface. The hook section can have a curved wall and with the ledge section the two portions of the Y-shape or forked shape can create a central cavity.

An extending lip can be formed on the outer surface of the hook section and can extend away from the curved wall.

Opposite the extending lip, that can extend the entire length of the slat body, can be a reinforced section. The reinforced section can be disposed between the curved wall and a top hook of the top hook portion.

The top hook can have a hook end that can be curved. The hook end of the top hook can be opposite the ledge and a first opening is formed between the ledge and the hook end.

The curved portion of the top hook can form a second cavity. The second cavity can be generally opposite the central cavity but the two cavities are not aligned. The second cavity can enable the unique interlocking feature between the slats, enabling the slat bodies to interconnect pivotally together.

Formed as part of the slat body opposite the first end, which can be a second end, can be a bottom receptacle portion.

The second end can be formed from a portion of the curved back side.

The bottom receptacle portion can have a counter wall with a counter wall end formed opposite a bottom hook with a bottom hook end. The inner portions, which can be the inner sides of each of the counter walls and the bottom hook can form a bottom cavity. Additionally the bottom hook end can end before connecting the outer wall end forming a bottom opening between the counter wall and the bottom hook.

The top hook of a first slat body can be adapted to slide into the bottom opening along the entire length of a second similarly formed the slat body. This construction can allow the integral engagement of the two slat bodies and can allow the slats as one piece constructs to pivotably engage between the bottom hook and the counter wall, which can further allow the counter wall end to rest on the extending lip, which can be the entire length of the slat body, and the bottom hook end can rest on the ledge, which can also be the entire length of the slat body.

An additional alignment device can be used in an end of the slat body to engage the central cavity and align a first shutter slat with a second shutter slat in the central cavity. The alignment device can have an alignment head for receiving a tool to tighten down the alignment device, or for receiving a tool that allows a slidable insertion of the alignment tool into the central cavity. The alignment device can be between about 1 centimeter to about 7 centimeters in length and can have a body portion that slides within the cavity, but a head portion does not slide within the cavity. The present embodiments provide a small roll diameter for the slats. In general, the smaller the overall width of a slat, the smaller the roll diameter it forms. A small roll diameter can convert into a better opening/housing size ratio. Compared to other rolling shutter slats, which are typically double wall, this slat can have a small overall width and thus a better opening/housing size ratio.

Additionally the present embodiments can provide the benefit of easy perforation. The embodiments can relate to a single walled slat body. A single wall slat can be perforated easier than a regular hollow shape. In a rolling shutter application, perforated slats can allow visibility through the assembled curtain, wherein the slat bodies inter-engage through the cavities forming a curtain of inter-engaged, pivotable slats.

The top hook portion of the slat body can provide a benefit in that the top hook portion can be a curved wall with a ledge section, both of which can surround the central cavity. This configuration can strengthen the entire top hook section, as more material can then be allocated and provide reinforcement of the hook. Furthermore the extra reinforcement section with the top hook portion can provide additional stability for the top hook. A strong top hook section can further prevent the profile from braking while imposed to strong forces, such as impact or wind velocity pressure.

Another benefit of the slat body is the curved design. The entire slat body design can be curved and sharp edges can then be avoided. An additional benefit of this design is that it can allow certain colors to be applied more easily to the front side, plus the curved design can prevent injury, and can also allow an easier distribution of forces within the slat.

An embodiment of the invention can also provide the benefit that the curtain formed from the inter-engaged slats can have a higher degree of engaged stability. The design of the entire slat body, as a curved one piece structure with the counter wall end, can allow the counter wall end to stand on the lip and it can allow the bottom hook end to stand on the ledge for a dual reinforced stability, on two points of contact rather than just one. The dual contacting support can render twice the level of stability, and can also prevent the slats from flapping and coming loose in high winds, such as during hurricanes, such as in force 5 winds as required for slats by the state of Florida under the 2009 hurricane protection regulations for hurricane shutters.

The dual support construction can allow the slat curtain to entirely close when multiple individual slats are engaged and can also provide more stability, as each slat body stands on each other. Instead of just being loosely engaged, the dual support configuration can provide more stability to the entire curtain.

Turning to the Figures, FIG. 1 shows a side view of a slat body 2. The slat body have an overall length from about 24 centimeters to about 8 meters and an overall height from about 40 millimeters to about 120 millimeters.

Each slat body can be a single wall solid construction, but in another embodiments each slat body can be a double walled hollow body construction. The shutter slat can have a thickness from about 1 millimeter to about 10 millimeters.

It can be contemplated that the shutter slat can be made of aluminum, steel, another alloy, a non-deforming composite, another non-deforming polymer, or combinations thereof.

It can be contemplated in an embodiment that the shutter slat can be encapsulated with a coating. The coating can be a paint, a metal, a urethane, or combinations thereof.

FIG. 1 further shows that the slat body 2 can be curved between a top hook portion 10 on a first end 15 and a bottom receptacle portion 36 on a second end 38. The slat body can have a curved front side 4, which can present a smooth front surface and a curved back side 6. The curve of the slat body can be similar to the top arc of a sinusoidal curve, with a curve arc of between about 10 degrees to about 170 degrees.

Figure 2:
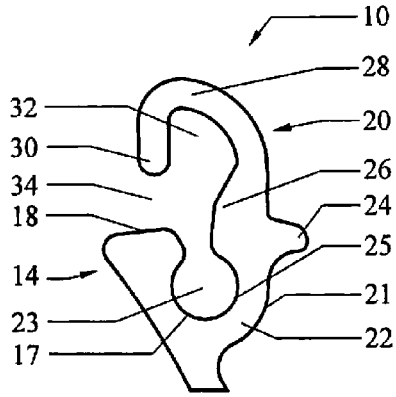
FIG. 2 is a detailed view of a top hook portion.

FIG. 2 shows a detail of the top hook portion 10. The top hook portion can range in length from about 1 centimeter to about 3 centimeters and in width from about 5 millimeters to about 30 millimeters. The top hook portion 10 can have two sections, a hook section 20 and a ledge section 14.

The hook section 20 can extend from the slat body 2 with a curved wall 22 that can engage the curved front side 4 of the slat body 2. The curved wall 22 can have an inner side 25 that can form a portion of the central cavity 23, and an outer portion that can also be curved. The diameter of the central cavity 23 can range from about 2.5 millimeters to about 10 millimeters.

The inner and outer curves of the curved wall can be parallel to each other, as shown in this Figure. Extending from the uppermost portion of the curved wall outer surface 21 can be an extending lip 24 which can extend the entire length of the slat body. The extending lip 24 can extend from about 1 millimeter to about 4 millimeters from the outer surface.

The top hook portion 10 can have a top hook 28 extending from the curved wall that curves around like a crooked index finger to the hook end 30 forming a second cavity 32. The second cavity 32 can be generally opposite the central cavity 23, but can be offset from each cavity's center point. The diameter of the second cavity 32 can range from about 3 millimeters to about 8 millimeters.

Opposite the curved wall 22 can be the ledge section 14 that can have a first curved inner wall 17 which can be connected to and extend opposite the inner side of the curved wall 22 forming the central cavity 23.

Opposite the hook end 30 in the ledge section 14 can be the ledge 18. An opening 34 can be formed between the hook end 30 and the ledge 18 which can range from about 3 millimeters to about 6 millimeters.

Extending into a space dividing the central cavity 23 and the second cavity 32 can be a reinforced section 26. The reinforced section 26 can be opposite the extending lip 24 on the inner side of the curved wall 22 at the top portion of the inner side 25.

The top hook portion 10 can look very similar in profile to a right hand in profile, with a thumb as the ledge section and the curved over digits as the top hook and the knuckle as the extending lip and the pad part of the palm as the reinforced section.

Figure 3:
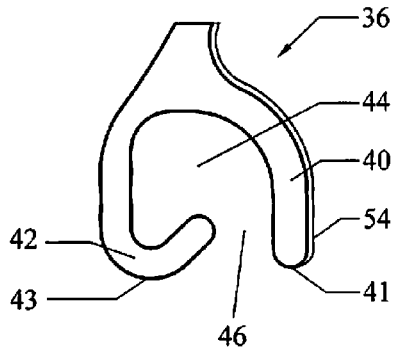
FIG. 3 is a detailed view of a bottom hook portion.

FIG. 3 shows another "hand-like" grip with a counter wall 40, which can extend from the slat body 2 with a slight curve, and a bottom hook 42, which can extend from the slat body 2 opposite the counter wall 40 forming the bottom cavity 44. The bottom cavity 44 can have a diameter from about 6 millimeters to about 10 millimeters. The bottom receptacle portion 36 is depicted in detail in FIG. 3.

The bottom hook 42 can have a bottom hook end 43 that can extend back towards the slat body 2 in the manner of a crooked finger. A bottom opening 46 can be formed between the bottom hook end 43 and the counter wall 40.

The counter wall 40 can also have a counter wall end 41 and the bottom hook 42 can have a bottom hook end 43.

FIG. 3 also shows the coating 54, which can be disposed on the bottom receptacle portion 36, which can stop static electricity buildup, and help to prevent an electrical path in the case of lightening strikes.

Figure 4:
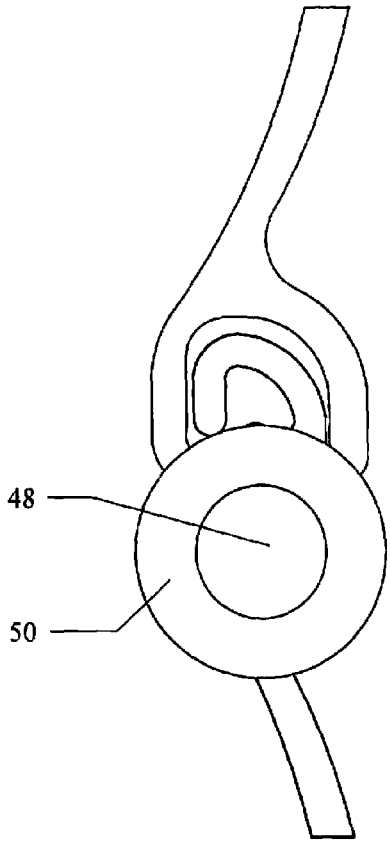
FIG. 4 is a side view of two interconnected slat bodies.

FIG. 4 shows a bottom receptacle portion 36 having within it, a top hook portion 10 with the extending lip 24 extending there from. Additionally, this embodiment shows an alignment device 50 in the central cavity 23 which can be held in place with a fastener 48, of which the fastener head is visible.

In an embodiment, the alignment device can be a threaded device. The alignment device can be a pop rivet and the alignment head can have a diameter larger than an outer diameter of the bottom receptacle portion.

In an embodiment, the alignment device can be a screw, a bolt, a pop rivet, a rod or combinations thereof. In an additional embodiment, the alignment device can be a retaining alignment lock. The retaining alignment lock can be used to additionally secure the shutter slates within the guide rails.

The alignment device can further be a metal rod adhesively secured in the central cavity and the adhesive can be a glue or cutting thread.

The alignment device 50 can be disposed in the central cavity 23 and can be secured into the central cavity with a fastener provided the alignment device is a hollow revolved U-shape with two heads, where each head has a diameter larger than an outer diameter of the bottom receptacle portion.

Figure 5:
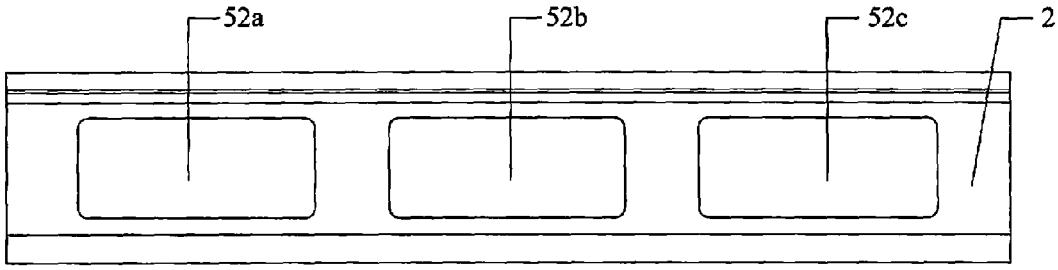
FIG. 5 is a detailed view of a perforation configuration for a slat body.

The alignment device can have a length between about 0.5 centimeter to about 9 centimeters and a diameter from about 0.5 centimeter to about 2 centimeters. The alignment device can further be hollow or solid FIG. 5 shows an embodiment of the invention wherein perforations 52*a*, 52*b*, 52*c* are in the slat body 2.

The plurality of perforations 52*a*, 52*b*, 52*c* can be disposed through each slat body and can all have the same shape, such as a triangle, square, rectangular, another geometrical shape or combinations thereof.

An embodiment can contemplate that some perforations can be larger than others for ease of viewing out of a window in a section protected by the shutters.

The density of the perforations can run from about 100 per square meter to about 10000 per square meter per slat body.

The plurality of perforations can each have an opening arranging from about 0.3 centimeters to about 10 centimeters.

In an embodiment, the plurality of perforations can be formed to insure that at least 60 percent of the slat material remains in the slat.

Figure 6:
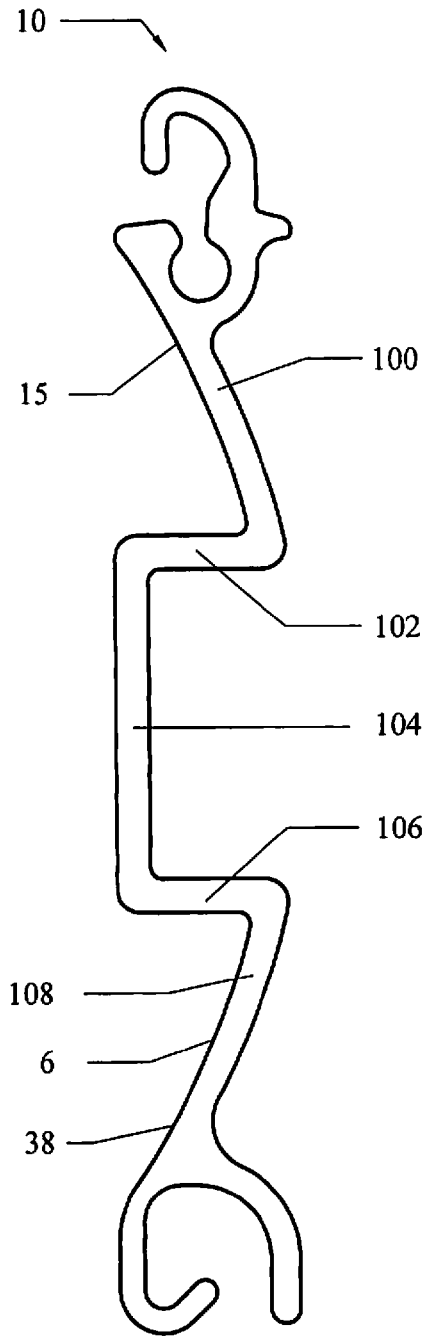
FIG. 6 is another embodiment of a slat body.

FIG. 6 shows another embodiment of the shutter slat for a rolling shutter system having with a first end 15 and a second end 38. The embodiment further shows the top hook portion 10 and the curved back side 6.

Connected to the first end 15 can be a first segment 100. A second segment 102 can be connected to the first segment 100 at an angle from about 30 degrees to about 60 degrees.

A third segment 104 can connect to the second segment and at an angle from about 80 degrees to about 100 degrees.

A fourth segment 106 can connect at an angle from about 80 degrees to about 100 degrees to the third segment and at an angle from about 30 degrees to about 60 degrees to a fifth segment 108 which can engage to the second end 38. The first end and second ends can each have the same configurations as the embodiment described in FIG. 1.

In the embodiment, the shape, of a "broken branch" can allow the slat to be used as an opener or for attachments of stopping mechanism which is a significant benefit to this design.

FIG. 7 depicts another alignment device 50. The alignment device 50 can have an adhesive coating 150. The adhesive coating 150 can secure the alignment device 50 to a central cavity.

While these embodiments have been described with emphasis on the embodiments, it should be understood that within the scope of the appended claims, the embodiments might be practiced other than as specifically described herein.

What is claimed is:

1. A shutter slat for a rolling shutter system comprising:

a. a single wall slat body;

b. a top hook portion formed on a first end of the single wall slat body, wherein the top hook portion comprises:

i. a ledge section, wherein the ledge section comprises a curved inner wall forming a first portion of a central cavity, and wherein the ledge section comprises a ledge connected with a terminal end of the curved inner wall; and ii. a hook section comprising:

1. a curved wall comprising an inner surface that forms a second portion of the central cavity, wherein the curved inner wall and inner surface are aligned with one another;

2. an extending lip extending from the curved wall on an outer surface;

3. a hook end extending toward the ledge section forming a second cavity, wherein a reinforced section that is thicker than the hook end and laterally opposite the extending lip is located between the central cavity and the second cavity, wherein the reinforced section is aligned with the ledge and laterally opposite the ledge, and wherein a space is formed between the reinforced section and the ledge, wherein the space is aligned with the second cavity and the central cavity, and wherein the space provides a unobstructed path from the central cavity to the second cavity; and 4. a first opening formed between the hook end and the ledge;

c. a bottom receptacle portion formed in a second end of the single wall slat body, wherein the bottom receptacle portion comprises a counter wall with a counter wall end opposite a bottom hook with a bottom hook end forming a bottom cavity with a bottom opening between the counter wall and the bottom hook;

d. wherein the top hook portion is adapted to slide into a bottom opening of an adjacent shutter slat to pivotably engage between the bottom hook and the counter wall allowing the counter wall end to be supported on the extending lip, and the bottom hook end to be supported on the ledge respectively, of the adjacent shutter slat for a dual reinforced stability of the bottom receptacle portion on the hook end of the adjacent shutter slat; and e. an alignment device disposed in the central cavity for aligning the shutter slat with the adjacent shutter slat in the central cavity.

2. The shutter slat of claim 1, wherein the alignment device further comprises a fastener and a fastener head.

3. The shutter slat of claim 1, wherein the alignment device is a metal rod adhesively secured in the central cavity.

4. The shutter slat of claim 1, further comprising a plurality of perforations disposed through the single wall slat body having a shape selected from the group: triangle, square, rectangular, another geometrical shape, or combinations thereof.

5. The shutter slat of claim 4, wherein the plurality of perforations each have an opening of at least 0.3 centimeters to 10 centimeters.

6. The shutter slat of claim 4, wherein the plurality of perforations are formed to insure that at least 60 percent of a slat material remains in the shutter slat.

7. The shutter slat of claim 1, wherein an overall length of each shutter slat is between 24 centimeters and 8 meters and an overall height is from 40 millimeters to 120 millimeters.

8. The shutter slat of claim 1, wherein a thickness of the single wall slat body is from 1 millimeter to 10 millimeters.

9. The shutter slat of claim 1, wherein the shutter slat comprises aluminum, steel, another alloy, a composite, a polymer, or combinations thereof.

10. The shutter slat of claim 9, wherein the shutter slat further comprises a coating encapsulating the shutter slat.

11. The shutter slat of claim 10, wherein the coating is a paint, a metal, a urethane, or combinations thereof.

* * * * *